US009018576B2

(12) United States Patent
Gong et al.

(10) Patent No.: US 9,018,576 B2
(45) Date of Patent: Apr. 28, 2015

(54) LOW DROP-OUT REGULATOR WITH DISTRIBUTED OUTPUT NETWORK

(75) Inventors: Jingfeng Gong, Singapore (SG); Yann Desprez-le-Goarant, Singapore (SG)

(73) Assignee: STMicroelectronics Asia Pacific Pte Ltd, Singapore (SG)

( * ) Notice: Subject to any disclaimer, the term of this patent is extended or adjusted under 35 U.S.C. 154(b) by 1023 days.

(21) Appl. No.: 13/104,697

(22) Filed: May 10, 2011

(65) Prior Publication Data

US 2012/0286135 A1 Nov. 15, 2012

(51) Int. Cl.

| | |
|---|---|
| ***H01J 40/14*** | (2006.01) |
| ***G05F 1/10*** | (2006.01) |
| ***G05F 1/46*** | (2006.01) |

(52) U.S. Cl.

CPC . *G05F 1/10* (2013.01); *G05F 1/461* (2013.01)

(58) Field of Classification Search

CPC ..... G05F 1/10; G05F 1/46; G05F 1/462; G05F 1/563; G05F 1/575; G05F 1/5735; H01J 40/00

USPC ..... 250/214 R; 307/31, 34, 52, 53; 323/272, 323/280, 281, 292

See application file for complete search history.

(56) References Cited

U.S. PATENT DOCUMENTS

| | | | | |
|---|---|---|---|---|
| 5,521,528 | A * | 5/1996 | Mammano et al. | 326/30 |
| 5,739,681 | A * | 4/1998 | Allman | 323/314 |
| 5,815,028 | A * | 9/1998 | Reynolds | 327/543 |
| 5,835,420 | A * | 11/1998 | Lee et al. | 365/189.09 |
| 6,232,753 | B1 * | 5/2001 | Pasotti et al. | 323/267 |
| 6,765,374 | B1 * | 7/2004 | Yang et al. | 323/280 |
| 2004/0076034 | A1 * | 4/2004 | Stahl | 365/149 |
| 2008/0054867 | A1 * | 3/2008 | Soude et al. | 323/282 |
| 2012/0161733 | A1 * | 6/2012 | Hua et al. | 323/282 |

* cited by examiner

*Primary Examiner* — Georgia Y Epps
*Assistant Examiner* — Kevin Wyatt
(74) *Attorney, Agent, or Firm* — Gardere Wynne Sewell LLP

(57) ABSTRACT

Disclosed is a low drop-out voltage regulator circuit with a distributed output network coupled to a pixel array for use in image sensor circuitry. The regulator circuit comprises voltage regulating circuitry and a distributed output network, wherein the distributed output network comprises drive transistors disposed along and connected between a supply track and an output track. The spatial distribution of the drive transistors improves heat dissipation within the regulator circuit, and a combination of low current flow and regulated output voltage reduces IR drop across the output track. The improved heat dissipation increases device lifespan and performance, whereas the reduction in IR drop across the output track provides better pixel response, readout uniformity, and image quality.

41 Claims, 3 Drawing Sheets

LOW DROP-OUT REGULATOR WITH DISTRIBUTED OUTPUT NETWORK

BACKGROUND

1. Technical Field

The present invention relates generally to integrated circuits implemented in image sensors and, more specifically, to a voltage regulator circuit having a distributed output network.

2. Introduction

Conventional image sensor technology typically implements a standalone voltage regulator to supply power to pixel arrays and readout circuitry. However, for image sensors having large pixel arrays, voltage variation is prevalent along the columns or rows of pixels due to IR drop (voltage drop) across a metal output track of the regulator. The IR drop across the output track results in unequal source impedances at each of the pixel columns or rows in the pixel array, causing various problems such as, for example, droop and unequal settling time for each pixel column or row. What's more, conventional voltage regulator circuits typically implement a dense unit transistor layout that often generates large amounts of heat within the circuit during high current consumption. As such, conventional regulator circuits suffer from heat dissipation issues that result in degraded performance and reduced lifespan of the device.

One solution for addressing the IR drop is to increase the width of the metal output track connecting the columns or rows of pixels. However, this solution requires a significant amount of circuit space, which is further complicated by the fact that the image sensor is only able to dedicate a limited number of metal layers for routing. In cases requiring high current consumption, any efficiency provided by this solution is generally minimized for applications incorporating a large pixel array. In addition to requiring significant space in the circuit, the greater track width may jeopardize stability of the regulator by causing an increased load capacitance. This proposed solution also fails to address the heat dissipation issues. Therefore, there exists a need for a voltage regulator circuit that reduces IR drop and improves heat dissipation without requiring a significant amount of additional circuitry within the regulator circuit.

SUMMARY

The present disclosure provides a low drop-out voltage regulator circuit with a distributed output network for use in image sensor circuitry. When compared to conventional regulator circuitry, the distributed output network of the disclosed regulator circuit improves localized heat dissipation by spatially-distributing transistors, and reduces IR drop across an output track by providing a consistent output voltage at each output node located along the output track. The improved heat dissipation increases device lifespan and performance, whereas the reduction in IR drop across the output track provides better pixel response, readout uniformity, and image quality for components connected to the distributed output network.

In one embodiment of the present disclosure, the circuit comprises a voltage regulator circuit having an error amplifier connected in a feedback loop with a first transistor to produce a regulated voltage, and a distributed output network coupled to the voltage regulator circuit. The distributed output network comprises a plurality of second transistors each having a source node disposed along a first metal track and an output node disposed along a second metal track, wherein each of the output nodes has a substantially consistent output voltage. Each of the second transistors are operable to supply an output current at their respective output nodes, and the output node of each of the second transistors is adapted to be directly connected to output circuitry.

Another embodiment of the present disclosure provides an integrated circuit comprising voltage regulating circuitry operable to receive an unregulated input voltage and produce a regulated output voltage, and distributed output network circuitry adapted to be coupled to output circuitry and operable to output a current and said regulated output voltage. The distributed output network circuitry comprises a plurality of first transistors each having first nodes coupled together and second nodes coupled together, wherein said first nodes each receive a first current and said unregulated input voltage and said second nodes each receive said regulated output voltage from said voltage regulating circuitry and an output current from one of said first transistors, said regulated output voltage being substantially consistent at each of said second nodes. The distributed output network circuitry is adapted to be coupled to the output circuitry directly at the second nodes of the first transistors to provide said regulated output voltage and said output current to the output circuitry.

Another embodiment of the present disclosure provides a circuit comprising a voltage regulator operable to produce a regulated voltage and a distributed output network coupled to the voltage regulator. The voltage regulator comprises an error amplifier and a first transistor connected in a feedback loop, wherein the voltage regulator produces the regulated voltage at a regulated node of the first transistor. The distributed output network comprises a plurality of second transistors each operable to provide an output current. Each of the second transistors have a source node disposed along a first metal track and an output node disposed along a second metal track. The first metal track is operable to receive and supply a first voltage and supply current to the source nodes; and the second metal track is operable to receive the regulated voltage from the regulated node and supply the regulated voltage to each of the output nodes. The regulated voltage is substantially consistent at each of the output nodes. Each output node receives an output current from one of the second transistors, and is adapted to be directly connected to output circuitry to provide the regulated voltage and the output current to the output circuitry.

The foregoing and other features and advantages of the present disclosure will become further apparent from the following detailed description of the embodiments, read in conjunction with the accompanying drawings. The detailed description and drawings are merely illustrative of the disclosure, rather than limiting the scope of the invention as defined by the appended claims and equivalents thereof.

BRIEF DESCRIPTION OF THE DRAWINGS

Embodiments are illustrated by way of example in the accompanying figures not drawn to scale, in which like reference numbers indicate similar parts, and in which.

DETAILED DESCRIPTION OF THE DRAWINGS

Figure 1A:
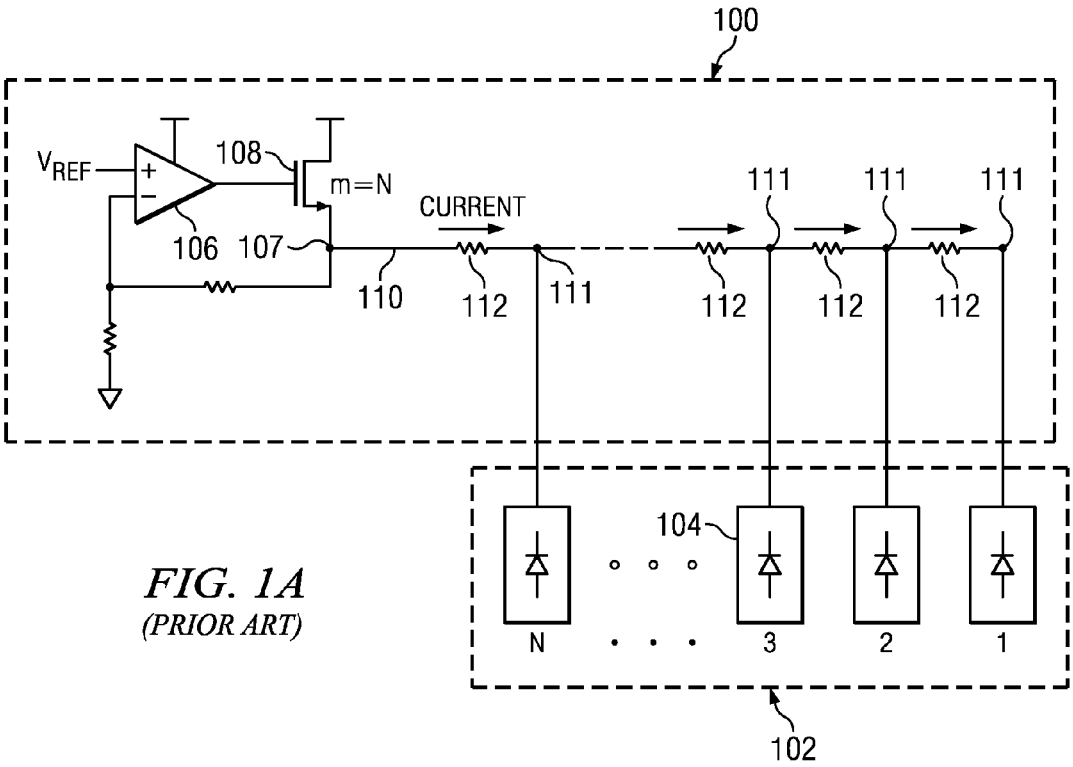
FIG. 1A (PRIOR ART)
FIGS. 1A and 1B illustrate various embodiments of a prior art voltage regulator circuit.
Figure 1B:
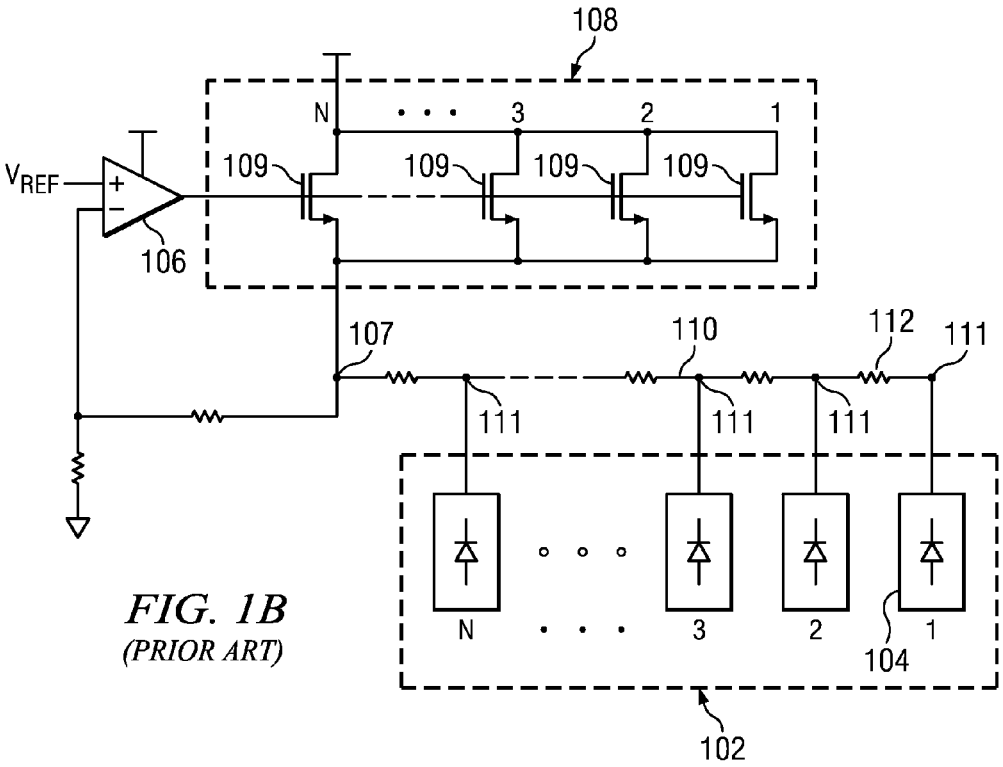
FIG. 1B (PRIOR ART)

FIG. 1A illustrates an integrated circuit having a conventional regulator circuit 100 coupled to a pixel array 102 comprising N columns 104 each including a plurality of rows. The regulator 100 comprises an error amplifier 106 connected in a feedback network with an output transistor 108 to produce a regulated voltage at a regulated node 107. Although the output transistor 108 in FIG. 1A is shown as a single transistor, it should be understood that the output transistor 108 actually represents a relatively dense layout of N unit transistors 109 connected in parallel as shown in FIG. 1B. As such, the output transistor 108 has an effective size (i.e., effective length and effective width) determined in accordance with the total number of unit transistors 109 represented by the output transistor 108. In FIG. 1A, the output transistor 108 has a multiplication factor (m) of N (i.e., m=N), meaning the effective total transistor size of the output transistor 108 is scaled according to the number of columns 104 in the pixel array 102. Specifically, the effective size of the output transistor 108 is scaled such that the output transistor 108 has an effective length ($L_O$) equal to the length ($L_U$) of each unit transistor 109 (i.e., $L_O=L_U$) and an effective width ($W_O$) equal to the number of unit transistors 109 times the width ($W_U$) of each unit transistor 109 (i.e., $W_O=N*W_U$). For example, in the embodiment shown in FIG. 1B, the pixel array 102 comprises N columns 104, and the output transistor 108 represents N unit transistors 109. As such, for each unit transistor 109 having a width of $W_U$ and a length of $L_U$, the output transistor 108 has an effective width ($W_O$) equal to $N*W_U$, and an effective length ($L_O$) equal to $L_U$. In another embodiment (not shown), if the pixel array comprises N columns 104, the output transistor 108 could represent 2N unit transistors having widths ($W_{U2}$) half the size of those shown in FIG. 1B (i.e., $W_{U2}=0.5*W_U$). In this embodiment, the output transistor 108 maintains effective length ($L_O$) and effective width ($W_O$), wherein $L_O=L_U$ and $W_O=2N*W_{U2}=2N*(0.5*W_U)=N*W_U$.

The output of the regulator 100 (i.e., the regulated voltage present at the regulated node 107) is coupled to the pixel array 102 by a metal output track 110, wherein each column 104 is coupled to the output track 110 at an output node 111. In the embodiment illustrated in FIGS. 1A and 1B, current travels from the drain of each of the unit transistors 109, to the regulated node 107, and along the output track 110 from one side of the pixel array 102 to the other, thereby providing power to each of the columns 104 at each output node 111. The regulator circuit 100 illustrated in FIGS. 1A and 1B has several drawbacks. For example, large amounts of current flowing through the dense layout of unit transistors 109 may generate large amounts of heat within the regulator circuit 100 which not only degrades performance, but also reduces the lifespan of the device. Additionally, as the current travels along the output track 110 to the columns 104 in the pixel array 102, metal line resistances 112 along the output track 110 cause IR drop along the output track 110. Therefore, different voltages are present at each of the output nodes 111 resulting in unequal source impedance for the pixel columns 104. It should be understood that the metal line resistances 112 are not physical resistors, but rather, parasitic resistance along the metal output track 110, wherein the metal line resistances 112 may vary depending upon several factors including, for example, thickness of the output track 110, the number of metal layers provided in the circuit, and the processes used to fabricate the circuit.

The present disclosure provides a low drop-out voltage regulator circuit with a distributed output network for use in image sensor circuitry. When compared to conventional regulators (e.g., see FIGS. 1A and 1B), the distributed output network of the disclosed regulator circuit improves localized heat dissipation and reduces IR drop across the output track and pixel array without requiring a significant amount of additional circuitry. The improved heat dissipation increases device lifespan and performance, whereas the reduction in IR drop across the pixel array provides better pixel response, readout uniformity, and image quality. Because the disclosed regulator circuit provides low IR drop across the output track, the disclosed regulator circuit may be suitable for applications using lower-voltage power supplies (e.g., batteries), regardless of whether or not they include an external capacitor.

Figure 2:
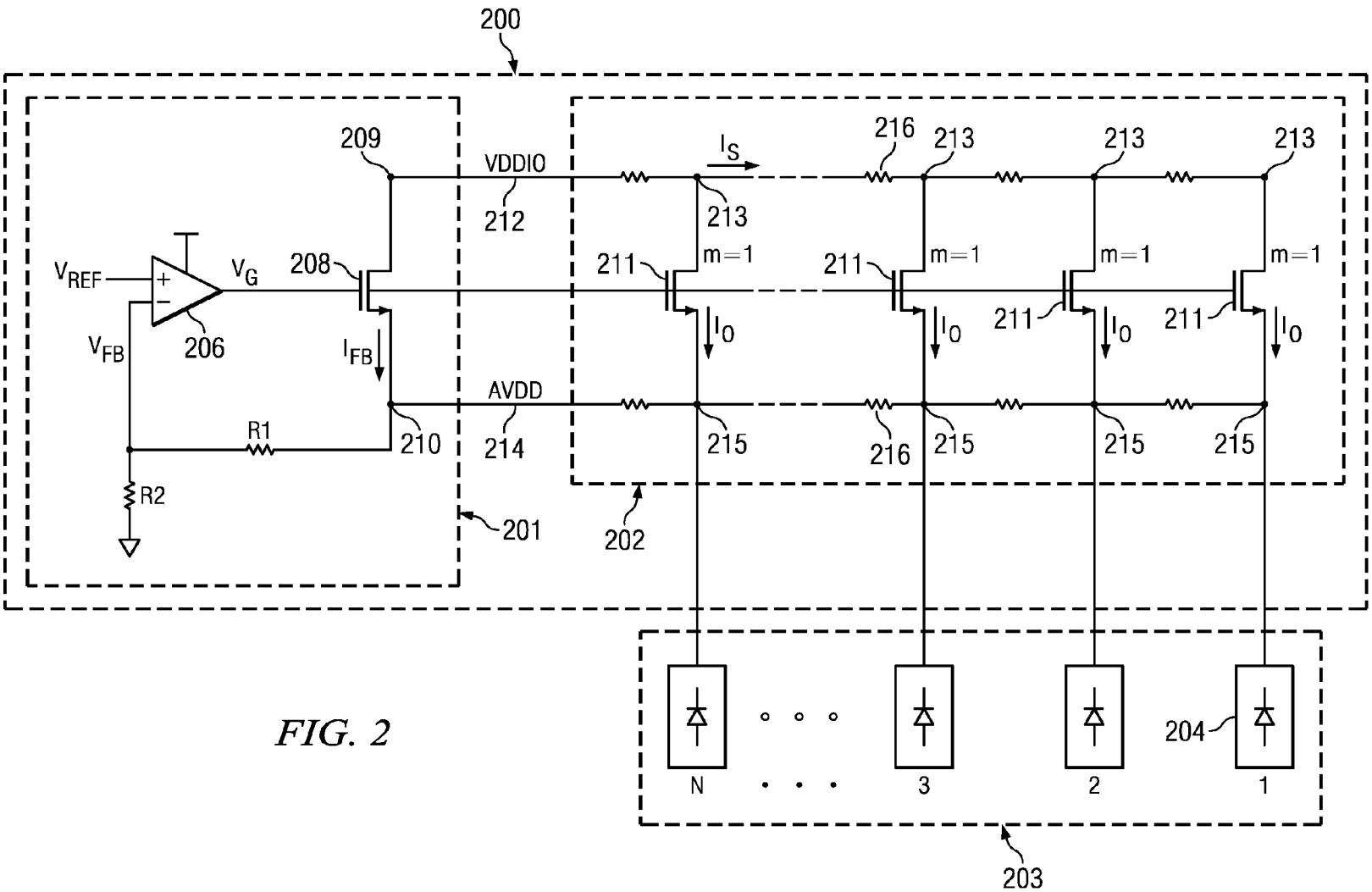
FIG. 2 illustrates an example regulator circuit coupled to a pixel array in accordance with an embodiment of the present disclosure.

FIG. 2 illustrates an example embodiment of the disclosed low drop-out voltage regulator circuit 200 in accordance with the present disclosure. The regulator circuit 200 consists primarily of two main components: voltage regulating circuitry 201 and a distributed output network 202, wherein the distributed output network 202 is generally comprised of a number of spatially-distributed transistors disposed along and connected between two metal tracks. In the embodiment shown in FIG. 2, the distributed output network 202 is coupled to a pixel array 203 comprising N columns 204, wherein each column 204 includes a plurality of rows. In an alternate embodiment (not shown), the distributed output network 202 may be coupled to the rows of a pixel array, wherein each row in the pixel array comprises a plurality of columns. Throughout the present disclosure the term "spatially-distributed" refers to a layout or positioning of particular components (e.g., transistors) having a spatial distance therebetween. One advantage of such spatial distribution is that heat caused by high amounts of current flowing through said components may be dissipated throughout the circuitry. As an example, spatially-distributed transistors may be positioned with a pitch equal to the pitch of the columns (or rows) to which they are coupled.

As shown in FIG. 2, the voltage regulating circuitry 201 comprises an error amplifier 206 (receiving reference voltage $V_{REF}$ and feedback voltage $V_{FB}$) connected in a feedback network with resistors R1 and R2, and regulator transistor 208. The regulator transistor 208 receives, from either an internal or external voltage supply (not shown), unregulated input voltage VDDIO at a source node 209, and is controlled by gate signal $V_G$, received from the error amplifier 206, to produce a regulated feedback voltage AVDD at a regulated node 210 located at the drain of the regulator transistor 208. The regulator transistor 208 provides a feedback current $I_{FB}$ across resistor R1 to generate the feedback voltage $V_{FB}$ at an input to the error amplifier 206. The error amplifier 206 receives the feedback voltage $V_{FB}$, compares it to the reference voltage $V_{REF}$, and adjusts the gate signal $V_G$ in accordance with the difference between the received voltages to control the regulator transistor 208 to produce the regulated voltage AVDD.

The distributed output network 202 is generally comprised of N spatially-distributed drive transistors 211 (also referred to herein as unit transistors), each connected directly to a pixel column 204. The drive transistors 211 are disposed along a supply track 212 and an output track 214, and each receive gate signal $V_G$ from the error amplifier 206. The source nodes 213 of the drive transistors 211 are coupled together along supply track 212. The supply track 212 is coupled to the source node 209 of the regulator transistor 208, and thus receives voltage VDDIO and provides supply current $I_S$ to the source nodes 213 of each of the drive transistors 211. Output nodes 215 of the drive transistors 211 are coupled together along output track 214, and output track 214 is coupled to the regulated node 210. Accordingly, the output nodes 215 receive the regulated output voltage AVDD produced by the voltage regulating circuitry 201. As shown in FIG. 2, supply track 212 and output track 214 have metal line resistances 216, wherein the metal line resistances 216 are not physical resistors, but rather, parasitic resistance along the respective tracks 212 and 214. The metal line resistances 216 may vary depending upon several factors including, for example, thickness of the respective tracks 212 and 214, the number of metal layers provided in the circuit, and the processes used to fabricate the circuit.

Each pixel column 204 in the array 203 is coupled directly to an output node 215 along the output track 214, and each drive transistor 211 provides output current $I_O$ directly to the pixel column 204 coupled to its respective output node 215. As shown in FIG. 2, the drive transistors 211 are spatially-distributed such that the drive transistors 211 have a pitch equal to the pitch of the columns 204. Additionally, each drive transistor 211 has a multiplication factor (m) of 1 (i.e., m=1), meaning each drive transistor 211 is scaled to provide current to one pixel column 204. Therefore, the drive transistors 211 are spatially-distributed such that the current flows from the supply track 212 to each drive transistor 211, and from each drive transistor 211 to one pixel column 204, thus providing improved heat dissipation throughout the regulator circuit 200.

As described above, the regulator circuit 200 is designed such that the supply current $I_S$ generally flows along the supply track 212 to each drive transistor 211, and from each drive transistor 211 to a pixel column 204 (as output current $I_O$), with little current flowing along the output track 214. Additionally, the voltage regulating circuitry 201 produces a consistent, regulated voltage AVDD at the regulated node 210. Therefore, since there is little current flow along the output track 214, the regulated voltage AVDD remains substantially consistent at each of the output nodes 215 along the output track 214. In essence, the substantially consistent regulated output voltage AVDD at each of the output nodes 215 provides reduced IR drop along the output track 214 even if IR drop occurs along the supply track 212. Since each pixel column 204 is directly connected to an output node 215, the pixel column 204 is powered by the output current $I_O$ (received from its respective drive transistor 211) and the regulated voltage AVDD present at the output node 215 to which the pixel column 204 is coupled.

In accordance with the foregoing, the distributed output network 202 of the disclosed regulator circuit 200 generally comprises spatially-distributed drive transistors 211 disposed along and connected between supply track 212 and output track 214. The spatial distribution (and subsequent current flow) of the drive transistors 211 improves heat dissipation, and the combination of low current flow and regulated output voltage AVDD reduces IR drop along the output track 214, thus producing substantially consistent source impedances at each of the pixel columns 204.

Figure 3:
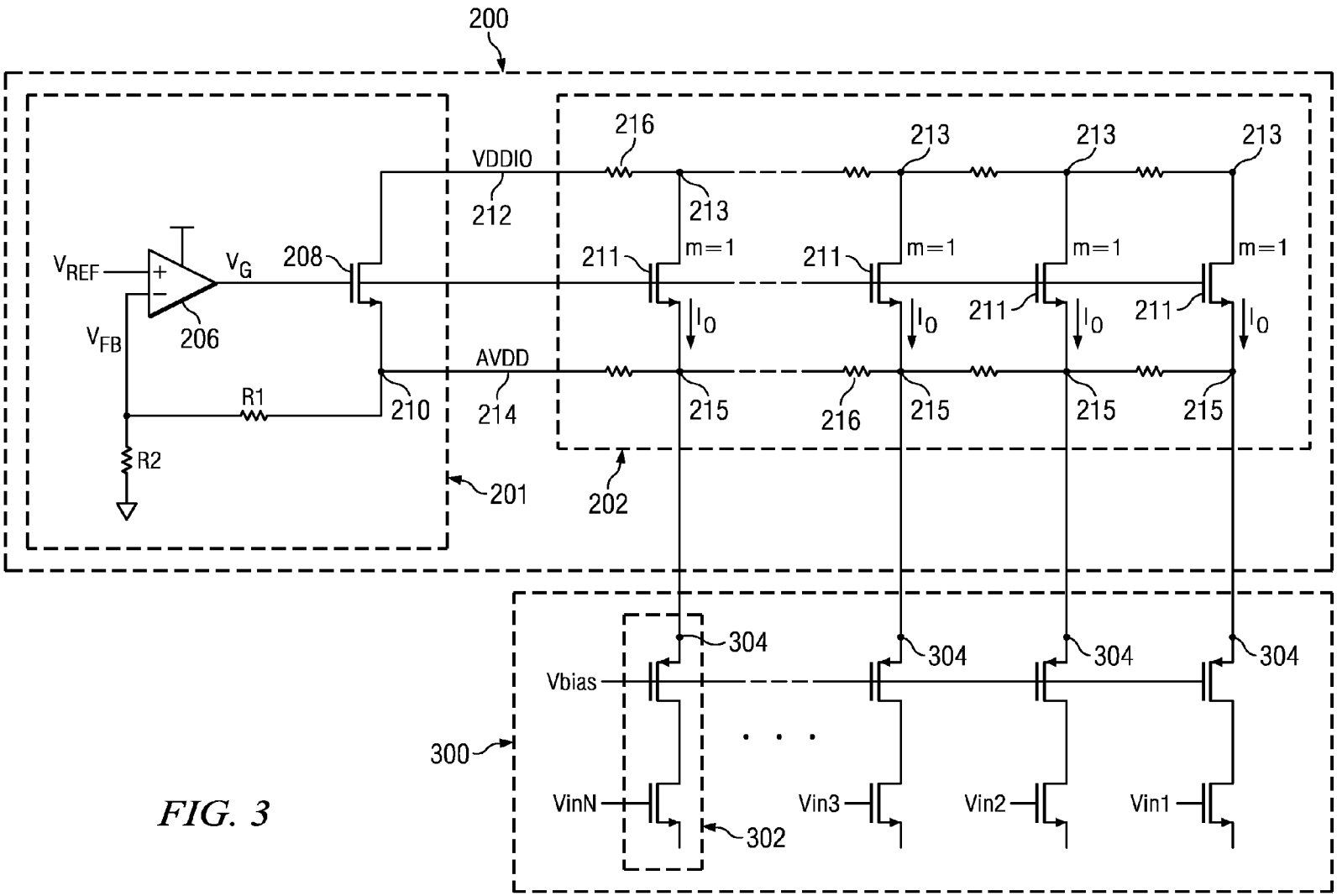
FIG. 3 illustrates an example regulator circuit coupled to readout circuitry in accordance with an embodiment of the present disclosure.

FIG. 3 illustrates another embodiment of the present disclosure wherein the disclosed regulator circuit 200 is coupled to readout circuitry 300. The embodiment shown in FIG. 3 is similar to that shown in FIG. 2, except that each of the output nodes 215 are coupled to a single stage amplifier 302 of a readout array 300, wherein each of the stages 302 are either AC or DC coupled throughout the readout array 300. Each output node 215 provides the output current $I_O$ and the regulated output voltage AVDD directly to a source node 304 of each stage 302 of the readout circuitry 300. The disclosed regulator circuit 200 may be configured such that each output node 215 powers a single stage 302, as shown in FIG. 3 or, alternatively, each output node 215 may power multiple stages 302 of the readout circuitry 300 (not shown). As discussed above, the disclosed regulator circuit 200 reduces IR drop along the output track 214 thereby providing a consistent output voltage at each output node 215 and readout circuitry source node 304, thus improving droop throughout the readout circuitry 300. It should be appreciated that the readout circuitry 300 shown in FIG. 3 is one example embodiment of readout circuitry that may be coupled to the distributed output network of the disclosed regulator circuit 200. For example, the readout circuitry may comprise amplifier stages that are inverting or non-inverting, single-ended or differential, AC-coupled or DC-coupled.

For purposes of describing the disclosed regulator circuit, the distributed output network is shown and described herein as coupling to a number of columns of pixels, rows of pixels, or readout circuitry. However, it should be appreciated that the circuitry coupled to the distributed output network may include other circuitry that may receive a regulated voltage provided by the disclosed regulator circuit. It should be appreciated that various adaptations and alterations may be made to the disclosed regulator circuit without departing from the spirit and scope of the present disclosure as set forth in the claims below.

What is claimed is:

1. A circuit comprising:

a first metal track having a plurality of electrically connected first spaced-apart nodes;

a second metal track having a plurality of electrically connected second spaced-apart nodes;

a plurality of current sources coupled between first and second spaced-apart nodes of said first and second metal tracks, wherein each second spaced-apart node is configured to receive a current injected from one of said current sources, each current source controlled by a control signal generated by a voltage regulator, said control signal further controlling generation of a regulated voltage by said voltage regulator, said regulated voltage applied to said second metal track;

wherein each of said second spaced-apart nodes are adapted to provide said injected current and said regulated voltage directly to output circuitry;

wherein said output circuitry comprises a plurality of pixel columns in a pixel array; and wherein pixel columns in the pixel array have a first pitch, and said current sources have a second pitch equal to said first pitch.

2. The circuit as set forth in claim 1, further comprising said voltage regulator, wherein said voltage regulator comprises an error amplifier connected in a feedback loop with a transistor coupled between the first and second metal tracks.

3. The circuit as set forth in claim 2, wherein said error amplifier is configured to generate said control signal to control said transistor and each of said plurality of current sources coupled between first and second spaced-apart nodes.

4. The circuit as set forth in claim 2, wherein said error amplifier is configured to generate said control signal to control said regulated voltage at a regulated node.

5. The circuit as set forth in claim 4, wherein said second metal track is connected to said regulated node.

6. The circuit as set forth in claim 1, wherein said second metal track has a parasitic resistance between each of said second spaced-apart nodes.

7. The circuit as set forth in claim 1, wherein said voltage regulator is a low drop-out voltage regulator.

8. The circuit as set forth in claim 1, wherein each of the current sources comprises a transistor having a first conduction terminal coupled to the first metal track at one of the first spaced-apart nodes and a second conduction terminal coupled to the second metal track at one of the second spaced-apart nodes.

9. The circuit as set forth in claim 1, wherein said first metal track is configured to receive an unregulated voltage.

10. A circuit comprising:

a voltage regulator comprising an error amplifier connected in a feedback loop with a first transistor to produce a regulated voltage; and a distributed output network coupled to said voltage regulator, said distributed output network comprising:

a plurality of second transistors each having a source node disposed along a first metal track which electrically connects the source nodes together and an output node disposed along a second metal track which electrically connects the output nodes together, wherein said regulated voltage is applied to said second metal track;

wherein each of said second transistors are operable to supply an output current at their respective output nodes, and further wherein the output node of each of said second transistors is adapted to be directly connected to output circuitry;

wherein said output circuitry comprises a plurality of columns of pixels in a pixel array, wherein each column is directly coupled to an output node.

11. The circuit as set forth in claim 10, wherein a substantially consistent output voltage is present at each output node which is substantially equal to said regulated voltage.

12. The circuit as set forth in claim 10, wherein said first metal track is operable to receive an unregulated voltage and supply a first current to said plurality of second transistors.

13. The circuit as set forth in claim 10, wherein said plurality of second transistors are spatially distributed along said first and second metal tracks.

14. The circuit as set forth in claim 10, wherein each of said first and second transistors are operable to be controlled by a gate signal provided from said error amplifier to said first transistor.

15. The circuit as set forth in claim 10, wherein said regulated voltage is produced at a regulated node of said first transistor.

16. The circuit as set forth in claim 15, wherein said second metal track is coupled to said regulated node.

17. The circuit as set forth in claim 10, wherein said first transistor is operable to provide a feedback current across a resistor in said feedback loop to provide a feedback voltage at said error amplifier.

18. The circuit as set forth in claim 10, wherein said columns of pixels in the pixel array have a first pitch, and said plurality of second transistors have a second pitch equal to said first pitch.

19. The circuit as set forth in claim 10, wherein said voltage regulator is a low drop-out voltage regulator.

20. The circuit as set forth in claim 10, said second metal track having a parasitic resistance between each of said output nodes along said second metal track.

21. A circuit comprising:

a first metal track having a plurality of electrically connected first spaced-apart nodes;

a second metal track having a plurality of electrically connected second spaced-apart nodes;

a plurality of current sources coupled between first and second spaced-apart nodes of said first and second metal tracks, wherein each second spaced-apart node is configured to receive a current injected from one of said current sources, each current source controlled by a control signal generated by a voltage regulator, said control signal further controlling generation of a regulated voltage by said voltage regulator, said regulated voltage applied to said second metal track;

wherein each of said second spaced-apart nodes are adapted to provide said injected current and said regulated voltage directly to output circuitry;

wherein said output circuitry comprises a plurality of amplifiers in a readout array; and wherein the amplifiers in the readout array have a first pitch, and said current sources have a second pitch equal to said first pitch.

22. The circuit as set forth in claim 21, further comprising said voltage regulator, wherein said voltage regulator comprises an error amplifier connected in a feedback loop with a transistor coupled between the first and second metal tracks.

23. The circuit as set forth in claim 22, wherein said error amplifier is configured to generate said control signal to control said transistor and each of said plurality of current sources coupled between first and second spaced-apart nodes.

24. The circuit as set forth in claim 22, wherein said error amplifier is configured to generate said control signal to control said regulated voltage at a regulated node.

25. The circuit as set forth in claim 24, wherein said second metal track is connected to said regulated node.

26. The circuit as set forth in claim 21, wherein said second metal track has a parasitic resistance between each of said second spaced-apart nodes.

27. The circuit as set forth in claim 21, wherein said voltage regulator is a low drop-out voltage regulator.

28. The circuit as set forth in claim 21, wherein each of the current sources comprises a transistor having a first conduction terminal coupled to the first metal track at one of the first spaced-apart nodes and a second conduction terminal coupled to the second metal track at one of the second spaced-apart nodes.

29. The circuit as set forth in claim 21, wherein said first metal track is configured to receive an unregulated voltage.

30. A circuit comprising:

a voltage regulator comprising an error amplifier connected in a feedback loop with a first transistor to produce a regulated voltage; and a distributed output network coupled to said voltage regulator, said distributed output network comprising:

a plurality of second transistors each having a source node disposed along a first metal track which electrically connects the source nodes together and an output node disposed along a second metal track which electrically connects the output nodes together, wherein said regulated voltage is applied to said second metal track;

wherein each of said second transistors are operable to supply an output current at their respective output nodes, and further wherein the output node of each of said second transistors is adapted to be directly connected to output circuitry;

wherein said output circuitry comprises a plurality of rows of pixels in a pixel array, wherein each row is directly coupled to an output node.

31. The circuit as set forth in claim 30, wherein said rows of pixels in the pixel array have a first pitch, and said plurality of second transistors have a second pitch equal to said first pitch.

32. The circuit as set forth in claim 30, wherein a substantially consistent output voltage is present at each output node which is substantially equal to said regulated voltage.

33. The circuit as set forth in claim 30, wherein said first metal track is operable to receive an unregulated voltage and supply a first current to said plurality of second transistors.

34. The circuit as set forth in claim 30, wherein said plurality of second transistors are spatially distributed along said first and second metal tracks.

35. The circuit as set forth in claim 30, wherein each of said first and second transistors are operable to be controlled by a gate signal provided from said error amplifier to said first transistor.

36. The circuit as set forth in claim 30, wherein said regulated voltage is produced at a regulated node of said first transistor.

37. The circuit as set forth in claim 36, wherein said second metal track is coupled to said regulated node.

38. The circuit as set forth in claim 30, wherein said first transistor is operable to provide a feedback current across a resistor in said feedback loop to provide a feedback voltage at said error amplifier.

39. The circuit as set forth in claim 30, wherein said columns of pixels in the pixel array have a first pitch, and said plurality of second transistors have a second pitch equal to said first pitch.

40. The circuit as set forth in claim 30, wherein said voltage regulator is a low drop-out voltage regulator.

41. The circuit as set forth in claim 30, said second metal track having a parasitic resistance between each of said output nodes along said second metal track.

* * * * *